United States Patent [19]

Bergen

[11] 4,143,897

[45] Mar. 13, 1979

[54] FIRE SHIELDED DOORLATCH KNOB ASSEMBLY FOR LOCKSETS

[75] Inventor: Gary R. Bergen, Yorba Linda, Calif.

[73] Assignee: Emhart Industries, Inc., Farmington, Conn.

[21] Appl. No.: 842,059

[22] Filed: Oct. 14, 1977

[51] Int. Cl.[2] ..... E05C 13/00

[52] U.S. Cl. ..... 292/347

[58] Field of Search ..... 292/347, 169, 336.3, 292/1, DIG. 66

[56] References Cited

U.S. PATENT DOCUMENTS

| | | | |
|---|---|---|---|
| 2,425,611 | 8/1947 | Frost et al. | 292/347 |
| 2,728,597 | 12/1955 | Young | 292/347 |
| 3,149,871 | 9/1964 | Russell et al. | 292/347 |
| 3,955,387 | 5/1976 | Best et al. | 292/347 |

*Primary Examiner*—Richard E. Moore

*Attorney, Agent, or Firm*—Mahoney, Schick & Cislo

[57] ABSTRACT

A doorlatch knob assembly has a knob insert of a hollow knob projecting through a door mounted rose secured rotatable by a drive washer which, in turn, receives the outer end of a doorlatch connected spindle projecting outwardly through the drive washer drivingly engaged therewith, through the insert and into the hollow knob. A fire resistant shield is closely telescoped and engaged with the insert receiving the spindle outer end therein so as to close off the previous opening from the hollow knob inwardly and preserve the integrity of the spindle retainment of the doorlatch mechanism against flame penetration upon heat destruction of the knob. The shield may have formation engaging the spindle outer end to aid the drive washer for rotatably driving the spindle. Where a turnbutton shaft is involved, it will also be formed of fire resistant material and will be closely telescoped by the outer end of the shield, otherwise the outer end of the shield will be closed.

14 Claims, 7 Drawing Figures

FIRE SHIELDED DOORLATCH KNOB ASSEMBLY FOR LOCKSETS

BACKGROUND OF THE INVENTION

This invention relates to a fire shielded doorlatch knob assembly for locksets, and more particularly, to a doorlatch knob assembly of somewhat conventional form which has added thereto a most important unique shield of fire resistant material which will protect the integrity of an associated lockset doorlatch mechanism for greater lengths of time and prevent flame penetration thereto for greater lengths of time, as well as to the opposite doorlatch knob assembly of the lockset, in the event of heat destruction of the assembly knob. In certain of its more specific embodiment forms, the unique shield may also be integrated into the doorlatch knob assembly so as to at least aid such assembly in the rotative driving and retainment of the associated spindle, thereby adding to the security of the lockset doorlatch mechanism under the described adverse conditions. Furthermore, the unique fire shielding shield, whether of its more general or specific embodiment form, may be readily adapted for use with the usual plain knob assembly or turnbutton knob assembly forms.

In these more modern times, it is well known that people are becoming much more cognizant of the ever present dangers to human life occasioned by structure fires. Although the danger of fire is always present where any structure is concerned, one prominent area of concern is in residential structures, particularly where multiple residence units are contained within a single structure. As a result of this concern, therefore, a relatively large amount of development work has been expended toward improving the human fire protection in these multiple residence unit structures.

With the multiple residence unit structures, it is apparent that a fire developing in one residence unit will, under normal conditions, readily affect the adjacent units and ultimately will spread to affect those of lesser proximity. Although many improvements have been made in various building materials to retard the advance of flame destruction of walls and other structure components, thereby not only retarding the advance of fire within a given residence unit, but also from one unit to the next, a still further important improvement can be made which to this point in time has not been fully recongnized. That deals with a recommendation by experts in fire protection that improvement efforts must be made for minimizing the dangers to human life from fires in these multiple residence unit structures by confining for as long as possible a fire within one residence unit as to both flames and smoke to that particular unit, thereby providing a greater period of time, even though still possibly relatively short, for the occupants of the other units to be alerted and escape. Furthermore, confining the fire to a single unit for as long as possible will give a greater period of time for the arrival of fire fighting units prior to the entire structure being involved.

It is, therefore, an important goal to confine the flames and smoke within a given single multiple residence unit and one of the major solutions to this goal is to provide fire resistant entry doors for each individual unit. This, however, is still not the entire answer since a fire resistant entry door for an individual unit cannot serve its smoke and flame confinement purposes to that particular unit unless the fire resistant door remains closed. An entry door, of course, is retained closed by the lockset installed therein and such lockset must not only be constructed for retaining the entry door closed under normal conditions and against surreptitious manipulation and entry by intruders, but must also maintain these entry door retainment strengths under the heat and flame conditions which can involve even fire resistant door warpage if the before discussed increased fire protection is to be provided.

Past experience has shown that even though an entry door lockset is not only of sufficient strength to reasonably protect against intruders, but is also of sufficient strength to retain the entry door closed under relatively severe door warpage resulting from a contained heat caused by fire, such has only been true where the integrity of the lockset within the door and its bolt connection to the door frame can be maintained. In many prior instances, such integrity with standard entry door locksets has not been possible of maintainment. The internal residence unit flames and heat quickly attack the lockset inside knob assembly many times releasing the lockset bolt and permitting the door warpage to force or "pop" the door open. Even though the bolt mechanism internally of the door is such that the bolt will be retained engaged with the door frame even with a destruction of the lockset internal knob and its immediate mounting components, if there is a direct path exposed for flames to directly contact the bolt mechanism, this mechanism will also be quickly destroyed by the flames and heat so as to release the bolt and permit the entry door to open.

Again, without other considerations, a most obvious answer to the problem of such lockset heat and flame destruction would be to form the entire lockset assembly of fire resistant material such as fire resistant steel. However, to form the lockset of fire resistant steel would involve extremely high material and other production costs making the resultant lockset marketable at such a high selling price so as to be usable in only a few instances and not by the general consumer. For instance, in locksets presently used by the general consumer, the knob assemblies include hollow knobs formed of brass since brass is relatively easily formed into many aesthetically pleasing decorative shapes and surface finishes, but a hollow brass knob will not withstand any great amount of flame and heat so as to be subject to quick destruction. To form these same lockset knobs of fire resistant steel would be cost prohibitive as stated.

Still another factor involved with the locksets used by the general consumer is that for economic production and assembly, standard lockset assemblies have permanently open entry paths from internally of the hollow knobs, through the knob assembly and into the internal confines of the door upon which the lockset is mounted. This means that there is an open entry path from internally of the knob directly into the bolt mechanism within the door, as well as to the lockset exterior doorlatch knob assembly of the door, so that destruction of the knob by heat and flames gives a direct flame path to the bolt mechanism and other lockset exterior components subjecting them to immediate severe heating which can result in partial or complete destruction. Any such severe damage to the lockset presents imminent danger of door release destroying the effect of a fire resistant door as hereinbefore discussed.

OBJECTS AND SUMMARY OF THE INVENTION

It is, therefore, an object of this invention to provide a fire shielded doorlatch knob assembly for locksets having particular use in the inner lockset knob assembly for fire resistant doors of structures wherein, by the addition of a unique fire resistant shield to the assembly, a somewhat standard lockset may be economically converted to one which is markedly better serviceable for fire protection use. The unique fire resistant shield may be integrated into the knob assembly in such a manner that the standard knob assembly components remain nearly unchanged and so that only slight cost increases are involved. At the same time, the now fire shielded doorlatch knob assembly insures that the integrity of the lockset bolt mechanism engaged with the door frame will be maintained for longer periods of time approaching the times possible with much more expensive locksets formed substantially totally of fire resistant materials.

It is a further object of this invention to provide a fire shielded door latch knob assembly for locksets of the foregoing general character wherein the unique fire resistant shield is integrated into the knob assembly internally of the knob positioned so as to close off any entry openings inwardly through the knob assembly into the inner confines of the door. By such fire shield positioning, the hollow knob is, in effect, made expendable so that whether or not the knob is present, the integrity of the remainder of the assembly including the bolt mechanism and bolt, and other lockset components, are not affected for greater periods of time. Thus, the hollow knob can still be formed of thin brass with all of the attributes occasioned thereby and the quick destruction of the knob from heat will not be detrimental to the lockset fire protection qualities.

It is still a further object of this invention to provide a fire shielded door latch knob assembly for locksets of the foregoing general character and including the unique fire shield integrated therein within the hollow knob of the assembly wherein, despite the addition of the unique fire shield within the assembly, such assembly is still readily adaptable to lockset forms with or without the usual turnbutton mechanism within the knob assembly and while still retaining the fire protection qualities. In a preferred embodiment form of the fire shield, such shield is tubular in shape and is integrated into the knob assembly having an outer end portion projecting outwardly within the hollow knob. When the turnbutton mechanism is included in the knob assembly, the turnbutton shaft is formed of a fire resistant material and is telescoped by the fire shield projecting outwardly through the fire shield outer end closely surrounded thereby so as to close the outer end portion of the fire shield against flame penetration inwardly into the knob assembly. Where the turnbutton mechanism is not included, the fire shield outer end portion is closed, thereby serving the same flame penetration purposes.

It is also an object of this invention to provide a fire shielded door latch knob assembly which, in a preferred embodiment form, may include all of the foregoing advantageous structure and features, and may further include an additional added feature of at least aiding in retaining the knob assembly spindle in proper engagement with and for operation of the associated lockset bolt and bolt operating mechanism. In its preferred form, the fire shield receives the outer end of the bolt operating spindle therein and the fire shield is integrated into the knob assembly for normal rotation with and by the knob. Furthermore, the fire shield may include engagement means internally thereof operably engaging the spindle so as to transmit its rotation directly to the spindle, all while maintaining its unique fire protection purposes.

Other objects and advantages of the invention will be apparent from the following specification and the accompanying drawings which are for the purpose of illustration only.

DESCRIPTION OF THE BEST EMBODIMENTS CONTEMPLATED

Figure 1:
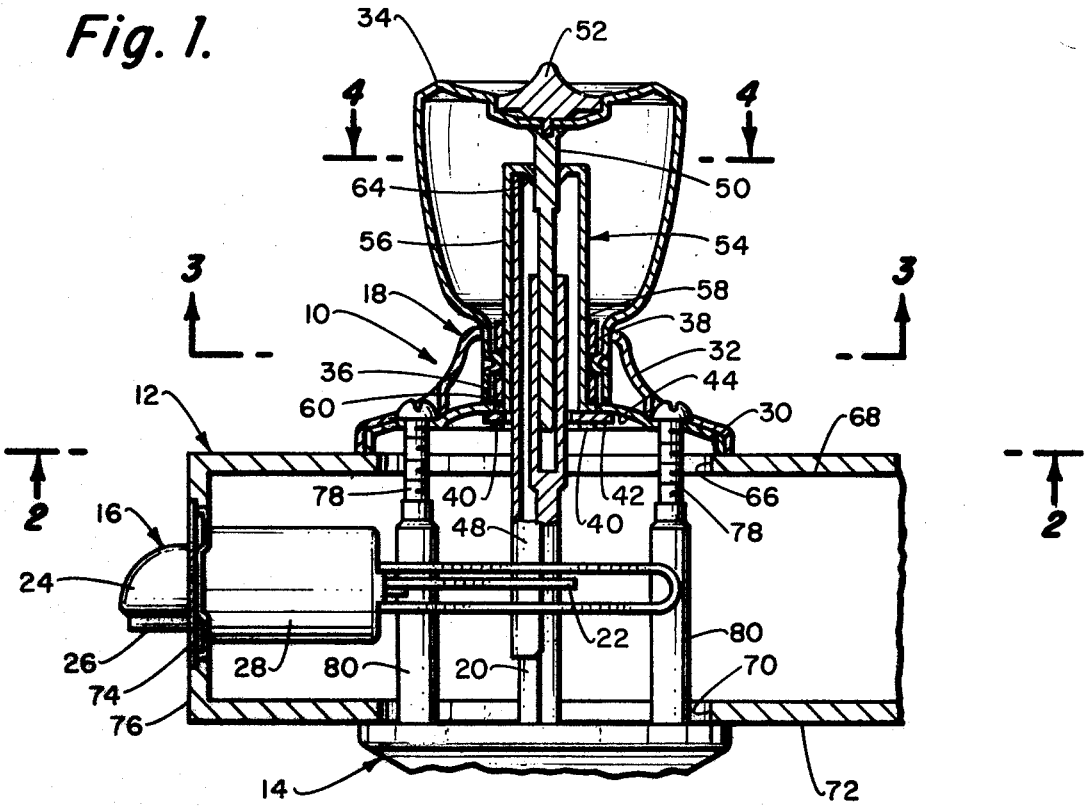
FIG. 1 is a fragmentary, horizontal sectional view of a first embodiment of a fire shielded doorlatch knob assembly incorporating the principles of the present invention, the knob assembly being integrated into a lockset as an inside knob assembly and the lockset being installed in a conventional fire resistant door.
Figure 2:
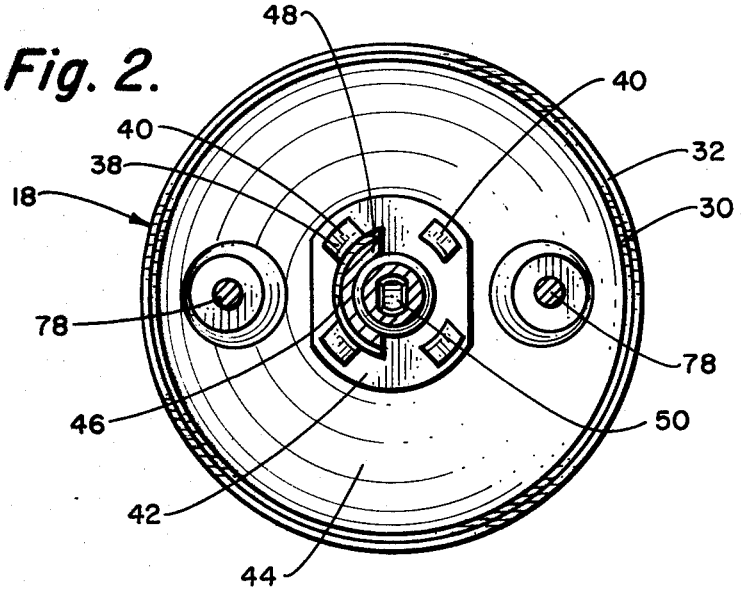
FIG. 2 is an enlarged, vertical sectional view looking in the direction of the arrows 2—2 in FIG. 1.
Figure 3:
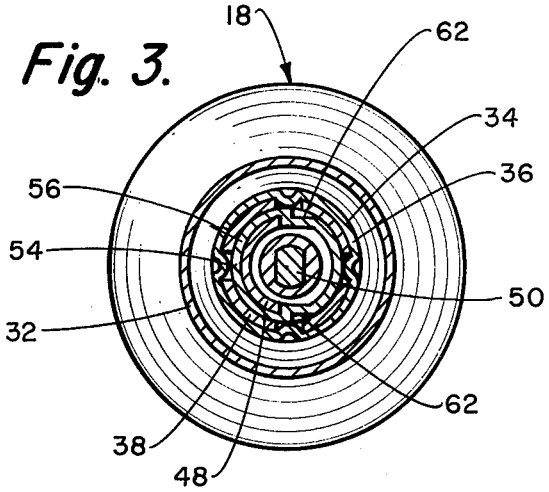
FIG. 3 is an enlarged, vertical sectional view looking in the direction of the arrows 3—3 in FIG. 1.
Figure 4:
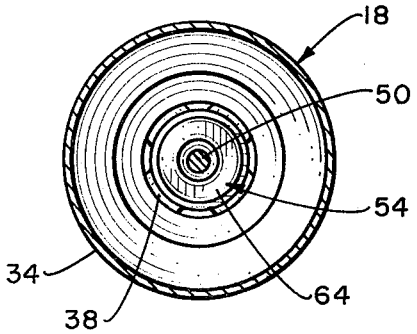
FIG. 4 is a vertical sectional view looking in the direction of the arrows 4—4 in FIG. 1.

Referring to FIG. 1, for the moment, a lockset generally indicated at 10 is shown mounted on a conventional fire resistant door generally indicated at 12, the door usually being formed of metal such as steel and of the type used, for instance, as an entry door of an individual residence unit in a multiple residence unit structure. The lockset 10 includes a conventional outside doorlatch knob assembly generally indicated at 14, a conventional doorlatch mechanism generally indicated at 16 internally of the door 12, and an inside doorlatch knob assembly generally indicated at 18, the latter incorporating the fire shielding principles of the present invention and thereby being an inside fire shielded doorlatch knob assembly. In the described environment, the outside doorlatch knob assembly 14 will include a lock (not known), usually a keyed, pin-tumbler lock, operably connected through a half round spindle 20 in driving connection with a bolt extension 22 of the doorlatch mechanism 16. The bolt extension 22 is operably connected for reciprocating a latch bolt 24, preferably including a deadlatch auxiliary bolt 26, all of which are housed within a deadlatch assembly 28 in usual manner.

The assembly of the lockset 10 with the fire resistant door 12 will be discussed later in slightly more detail, but at this time concentrating on the fire shielding principles of the present invention, the inside doorlatch knob assembly 18 is, for a large part, also of conventional form and referring to all of FIGS. 1 through 6, includes a somewhat flat, annular rose liner 30 telescoped and outwardly covered by a decorative, annular rose cover 32. A hollow knob 34, both decorative and functional, has an inner end 36 rotatably received inwardly through the rose cover 32 telescoping and secured by staking to a hollow knob insert 38. The knob insert 38 within the knob inner end 36 projects axially inwardly from generally the rose liner 30 inwardly from the knob 34 and rotatably through the rose liner 30 having four tabs 40 received axially through and radially staked against a drive washer 42 lying rotably against an inner surface 44 of the rose liner 30. Thus, the inner extremity of the knob insert 38 with its tabs 40 and the drive washer 42 constitute retainment means for the insert and knob 34 retaining the knob and insert rotatable on and opening axially through the rose liner 30 as well as the rose cover 32.

An inner opening 46 of the drive washer 42 is contoured for reception axially outwardly therethrough and in rotatable driving engagement therewith of an outer end of an axially extending, half round spindle 48, the spindle normally extending on axially outwardly through the insert 38 and into the hollow interior of the knob 34. A telescopically assembled two-part, turnbutton shaft 50 is positioned coaxially inwardly through the knob 34, through the insert 38, through the deadlatch assembly 28 including the bolt extension 22 and ultimately axially outwardly into the outside doorlatch knob assembly 14. This turnbutton shaft 50 has an enlarged turnbutton 52 outwardly accessible of the knob 34 and preferably recessed therein for limited rotation of the turnbutton shaft for performing its usual function of actuating the lock (not shown) within the outside doorlatch knob assembly 14 to lock or unlock the outside doorlatch knob assembly in usual manner.

Particularly important to the broader principles of the present invention, a unique fire resistant shield generally indicated at 54 is integrated into the inside doorlatch knob assembly 18 and includes a tubular wall 56 forming a hollow structure with a wall inner end portion 58 closely telescoped by the insert 38 and terminating axially within the insert in generally radial securement tabs 60 which pass radially or circumferentially interfit between the tabs 40 of the insert 38 securing the shield 54 rotatable with the insert and knob 34. The outer end of the half round spindle 48 is telescoped by the fire resistant shield 54 and a pair of appropriately circumferentially spaced spindle engagement portions 62 project radially internally of the fire resistant shield 54, preferably formed as radial depressions in the shield tubular wall 56 as shown, which circumferentially drivingly engage the spindle outer end. Thus, in this preferred form of the fire resistant shield 54, the outer end of the half round spindle 48 is not only circumferentially retained and circumferentially drivingly engaged by the drive washer 42, but is also similarly retained and drivingly engaged by the spindle engagement portion 62 of the fire resistant shield 54, both of the drive washer and fire resistant shield being rotatable by the knob 34 and the knob insert 38.

The tubular wall 64 of the fire resistant shield 54 is axially outwardly closed by a preferably integral end wall 65, of course, also formed of fire resistant material. In the particular first embodiment shown, with the turnbutton shaft 50 included in this inside doorlatch knob assembly 18, the turnbutton shaft extends axially through the shield end wall 64 and is closely surrounded thereby with only a very minimum of clearance therebetween to permit independent rotation of the turnbutton shaft relative to the shield. This fire resistant shield 54, therefore, as its most important function, since it terminates outwardly interiorly of the knob 34, closes off any through opening from interiorly of the knob axially inwardly through the knob insert 38 and along the half round spindle 48 to interiorly of the rose liner 30 or interiorly of this inside doorlatch knob assembly 18. As a supplementary function in its preferred form, this fire resistant shield 54 also cooperates with the drive washer 42 in retaining and rotatably driving the spindle 48 as described.

In assembly of the lockset 10 with the fire resistant door 12, the inside doorlatch knob assembly 18 is positioned at an appropriately formed opening 66 in a door inside wall 68, the outside doorlatch knob assembly 14 is similarly positioned at an appropriate opening 70 of a door outside wall 72, and the doorlatch mechanism 16 is positioned internally of the door between the inside and outside doorlatch knob assemblies with a mounting plate 74 of the deadlatch assembly 28 secured to a door end wall 76 and with the latchbolt 24 and the deadlatch auxiliary 26 projecting outwardly therethrough, all as shown in FIG. 1. In such positioning, the rose liner 30 and rose cover 32 of the inside doorlatch knob assembly 18 abut the outer surface of the door inside wall 68 closing the inside wall opening 66, the outside doorlatch knob assembly 14 having similar structure abutting the door outside wall 72 closing the outside wall opening 70. Furthermore, the half round spindle 48 of the inside doorlatch knob assembly 18 telescopes the half round spindle 20 of the outside doorlatch knob assembly 14, both passing through the doorlatch mechanism 16 and into proper operational engagement with the bolt extension 22 of the latchbolt 24 for proper functional operation of the latchbolt and its deadlatch auxiliary bolt 26 upon proper partial rotation of the half round spindles in usual manner. With this first embodiment construction including the turnbutton shaft 50 and the turnbutton 52, this turnbutton shaft will likewise be brought into its telescopic assembly adjacent the half round spindles 20 and 48. The entire assembly of the lockset 10 with the fire resistant door 12 is secured by fastening screws 78 passing through the rose liner and cover 30 and 32 of the inside door latch knob assembly 18 and being threadably engaged with fastening stems 80 projecting inwardly from the outside doorlatch knob assembly 14 and through the doorlatch mechanism 16 in usual manner.

Disregarding for the moment the fire resistant attributes, the lockset 10 will function in somewhat conventional manner. With the latchbolt 24 extended as shown in FIG. 1 and engaged in a door frame (not shown), the outside doorlatch knob assembly 14 may be conventionally unlocked, the knob thereof partially rotated to partially rotate the half round spindle 20 and the doorlatch mechanism 16 thereby conventionally actuated to withdraw the latchbolt 24 and its deadlatch auxiliary bolt 26 so that the door 12 may be opened. From the inside of the door 12 and with the door closed, the latchbolt 24 may be locked extended or unlocked by proper actuation of the turnbutton shaft 50 with the turnbutton 52. Furthermore, in unlocked condition, the knob 34 of the inside doorlatch knob assembly 18 may be partially rotated to simultaneously partially rotate the knob insert 38, the drive washer 42, and fire resistant shield 54 and thereby the half round spindle 48 for actuating the doorlatch mechanism 16 to withdraw the latchbolt 24 and permit opening of the door 12.

More particularly to the fire resistance qualities of the lockset 10 and keeping in mind that the prime interest here is the fire and resultant heat survival of the inside doorlatch knob assembly 18 for a reasonably maximum period of time and to the necessary extent for not only protecting the doorlatch mechanism 16, but also retaining the latchbolt 24 engaged with a door frame (not shown) for this maximum period of time despite warpage of the fire resistant door 12, the materials from which the various components of the lockset 10 are formed are important. Initially, and ignoring the materials of the lockset 10 as long as they are of reasonably thick metal materials for proper functioning, except for the fire resistant shield 54, the mere installation of the fire resistant shield in the inside doorlatch knob assembly 18 will greatly prolong the retaining powers of the inside doorlatch knob assembly 18 and prevent for this extended period of time the penetration of flames into the interior of the fire resistant door 12 and against the doorlatch mechanism 16, as well as on through the door 12 against the outside doorlatch knob assembly 14, so as to prolong the retention of the door closed by the latchbolt 24 despite heat warpage thereof. With the positioning of the fire resistant shield 54 within the inside doorlatch knob assembly 18, despite melting and destruction of the knob 34, flames are still prevented from inward penetration into the fire resistant door 12 so that the drive washer 42 will be protected retaining the half round spindle 48 to thereby retain the doorlatch mechanism 16 function. The addition of the spindle engagement portions 62 within the fire resistant shield 54 for added retention of the half round spindle 48 will even further prolong the spindle retention, again despite the materials of the remainder of the lockset 10.

However, even greater periods of life under these severe conditions can be obtained using particular materials for the remainder of the lockset 10, some of these materials being normal standard materials and others being purposely altered to give greater fire resistant life. In optimum form, the inside doorlatch knob assembly 18 will have the rose liner 30 formed of steel which would usually be its conventional material for strength, but under flame and heat conditions will importantly keep the inside door opening 66 closed for greater periods of time against flame penetration. The knob insert 38, sometimes previously formed of zinc, would be formed of steel, as would the drive washer 42, the half round spindle 48 and, of course, the fire resistant shield 54. The portion of the turnbutton shaft 50 extending outwardly through the fire resistant shield 54 would be steel, although the other portion thereof extending into the outside doorlatch knob assembly 14 can be zinc. The rose cover 32 and the knob 34 can be lesser fire resistant thin brass or bronze for their decorative qualities and ease of formation since these components are not required for the prolonged retention functioning so as to be expendable.

The fastening screws 78 of the inside doorlatch knob assembly 18 and the fastening stems 80 of the outside doorlatch assembly 14 should be steel, as well as the counterpart to the rose liner 30 within the outside doorlatch knob assembly, although the remainder of the outside doorlatch knob assembly may be of usual materials. These steel rose liners, fastening screws and fastening stems will prolong the life of retaining the knob assemblies in place preventing them from warping and melting for longer periods of time which will eventually destroy the effectiveness of the fire resistant components. Furthermore, keeping these steel rose liners in place, particularly the inside rose liner 30, maintains the inside door opening 66 closed against the flame penetration as hereinbefore alluded to. As is conventional in many cases, the doorlatch mechanism 16 may have all of the components thereof formed of steel except for the latchbolt 24 formed of brass and the deadlatch auxiliary bolt 26 formed of zinc.

Figure 7:
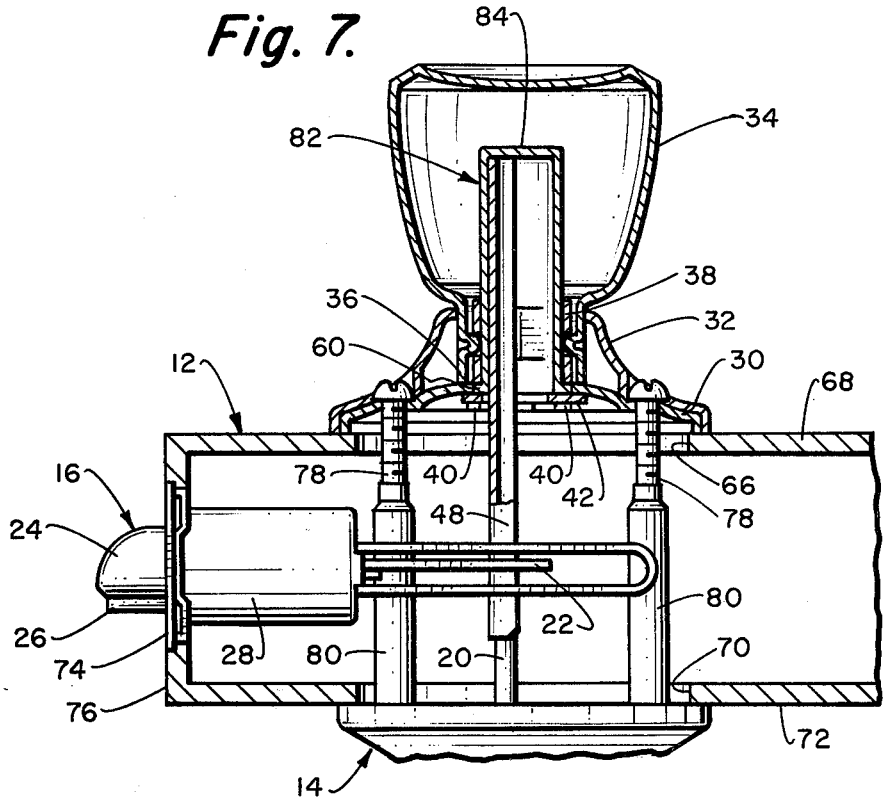
FIG. 7 is a horizontal sectional view similar to FIG. 1, but illustrating a second embodiment of the fire shielded doorlatch knob assembly of the present invention.
Figures 5, 6:
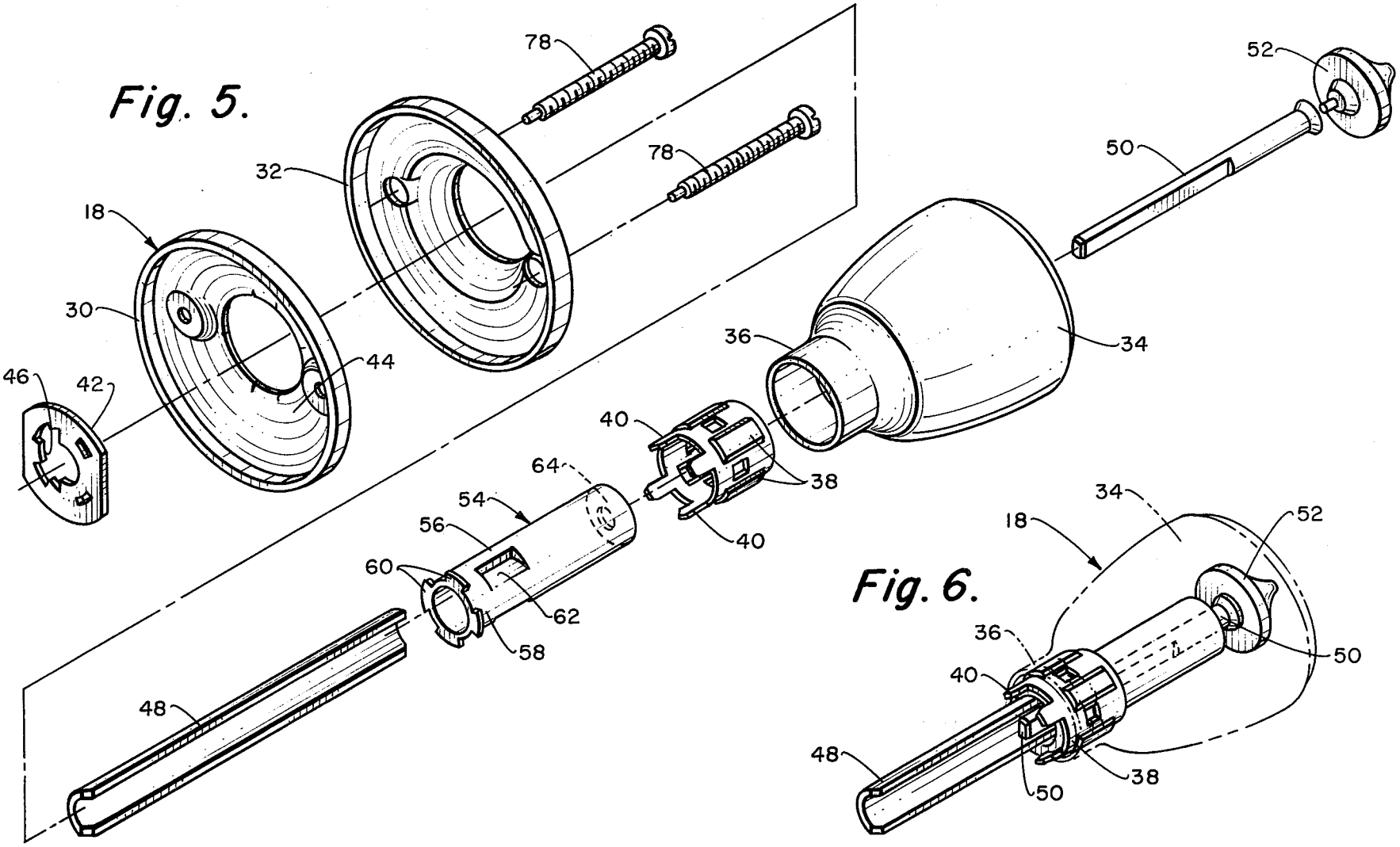
FIG. 5 is an exploded perspective view of the inside knob assembly of FIG. 1 incorporating the principles of the present invention.
FIG. 6 is a partial assembled perspective view of the inside knob assembly of FIG. 5 with the knob of the assembly shown in phantom lines.

The second embodiment of the fire shielded doorlatch knob assembly of the present invention is identical to the first embodiment just described with the exception of the removal of the first embodiment turnbutton shaft 50 and turnbutton 52 requiring only a slight modification of the unique fire resistant shield. As shown in FIG. 7, a fire resistant shield generally indicated at 82, likewise formed of steel, has a preferably integral, solid end wall 84, otherwise being identical to the first embodiment. Furthermore, the second embodiment fire resistant shield 82 is integrated into the lockset assembly in identical manner and serves the same purpose of preventing flame penetration into the interior of the particular door despite destruction from heat and flame of its surrounding knob.

Thus, using either embodiment of the fire shielded doorlatch knob assembly of the present invention incorporated in a lockset of a structure entry fire door, such as an individual unit entry door within a multiple residence unit structure, the door will be retained closed for a prolonged period of time despite contained flames and smoke within the individual unit, thereby prolonging the period of time before the flames and smoke escape from the single unit and ultimately involve other units of the multiple unit structure. Even with provision of the unique fire resistant shield in the inside doorlatch knob assembly as described while ignoring the possible improved materials of the remainder of the lockset assembly, the particular entry door will still be retained closed for a greater period of time despite flame and heat attack from a fire and the resultant door warpage, the unique fire resistant shield alone preventing early flame penetration to thereby delay lockset heat destruction from the ultimate failure of other lockset components. In the optimum form as described, the unique fire resistant shield in combination with other lockset components of more fire resistant materials will add to the critical period of time.

I claim:

1. In a fire shielded doorlatch knob assembly of the type having a hollow knob inwardly secured to a hollow generally cylindrical thickened insert and the insert extending through a mounting rose securable at a door side, the knob insert having retainment means thereon inwardly of the rose axially inwardly retaining the knob and insert rotatable relative to the rose, a spindle adapted for axially inward driving connection to a doorlatch mechanism and having an outer end telescoped by the knob insert and drivingly connected to the knob and insert, whereby a relatively large axial opening is formed along the spindle through the hollow insert and into the interior of the hollow knob normally permitting the reverse passage of flames through the assembly upon heat destruction of the knob; the improvements comprising: a hollow shield of fire resistant material mounted interiorly of the knob having wall means and outer end means thereon for respectively outwardly radially and outwardly axially closing off said insert opening into the knob interior, thereby preventing said reverse passage of flames through the assembly upon heat destruction of the knob.

2. In a fire shielded doorlatch knob assembly as defined in claim 1 in which said shield outer end means includes a closed end on the shield of fire resistent material.

3. In a fire shielded doorlatch knob assembly as defined in claim 1 in which said doorlatch knob assembly is of the type including a turnbutton shaft extending axially through said insert opening and through said knob interior; in which said turnbutton shaft is formed of a fire resistent material; and in which said shield outer end means includes a shield outer end of fire resistent material closely telescoping said turnbutton shaft.

4. In a fire shielded doorlatch knob assembly as defined in claim 1 in which an inner end portion of said shield wall means is closely telescoped by said insert.

5. In a fire shielded doorlatch knob assembly as defined in claim 1 in which an inner end portion of said shield wall means is closely telescoped by said insert and said spindle outer end extends axially into said shield; and in which there is means operably connecting said shield rotatable with said knob, insert and spindle.

6. In a fire shielded doorlatch knob assembly as defined in claim 1 in which an inner end portion of said shield wall means is closely telescoped by said insert and said spindle outer end extends axially into said shield; in which there is means operably connecting said shield rotatable with said knob and insert; and in which said shield wall means includes engagement means internally thereof drivingly connected to said spindle outer end.

7. In a fire shielded doorlatched knob assembly as defined in claim 1 in which an inner end portion of said shield wall means is closely telescoped by said insert and said spindle outer end extends into said shield; in which said shield is operably connected rotatable with said knob and insert; and in which said shield includes radially inwardly formed depressions drivingly engaged with said spindle outer end.

8. In a fire shielded doorlatch knob assembly as defined in claim 1 in which an inner end portion of said shield wall means is closely telescoped by said insert; and in which there is means generally radially interengaged between said inner end portion of said shield wall means and said insert retaining said shield rotatable with said knob, insert and spindle.

9. In a fire shielded doorlatch knob assembly as defined in claim 1 in which an inner end portion of said shield wall means is closely telescoped by said insert; and in which said inner end portion of said shield wall means includes generally radially extending tabs engaged with said insert retaining said shield rotatable with said knob, insert and spindle.

10. In a fire shielded doorlatch knob assembly as defined in claim 1 in which said insert retainment means inwardly of said rose is a drive washer secured to said insert; and in which said spindle outer end extends axially through said drive washer drivingly connected thereto and into said shield.

11. In a fire shielded doorlatch knob assembly as defined in claim 1 in which said insert retainment means inwardly of said rose is a drive washer secured to said insert; in which said outer end of said spindle extends axially through said drive washer drivingly engaged therewith and into said shield; in which an inner end portion of said shield wall means is closely telescoped by said insert; and in which said shield is operably connected to said insert rotatable with said knob, insert and spindle.

12. In a fire shielded doorlatch knob assembly as defined in claim 1 in which said insert retainment means inwardly of said rose is a drive washer secured to said insert; in which said outer end of said spindle extends axially through said drive washer drivingly engaged therewith and into said shield; in which said shield is operably engaged with said insert rotatable with said knob, insert and spindle; and in which said shield includes engagement means between said shield and said spindle outer end transmitting rotative drive therebetween.

13. In a fire shielded doorlatch knob assembly as defined in claim 1 in which said insert retainment means includes a drive washer inwardly of said rose secured to said insert; in which as inner end portion of said shield wall means is closely telescoped by said insert; in which said outer end of said spindle extends axially through said drive washer drivingly engaged therewith and into said insert; in which said shield is operably connected to said insert rotatable with said knob, insert and spindle; and in which radially inward depressions are formed on said shield drivingly engaged with said spindle outer end.

14. In a fire shielded doorlatch knob assembly as defined in claim 1 in which said insert retainment means inwardly of said rose includes a drive washer secured to said insert; in which an inner end portion of said shield wall means is closely telescoped by said insert and includes radial tab means drivingly interengaged with said insert for rotation of said shield with said knob and insert; in which said spindle outer end extends axially through said drive washer drivingly engaged therewith and into said insert; and in which said shield includes radially inward depressions drivingly engaged with said spindle outer end.

* * * * *